US009968832B1

(12) United States Patent
Lo

(10) Patent No.: US 9,968,832 B1
(45) Date of Patent: May 15, 2018

(54) FOOTBALL CAPABLE OF BEING QUICKLY LACED

(71) Applicants: Chien-Chuan Lo, Hua-Lien Hsien (TW); Yi-Chen Tsai, Hua-Lien Hsien (TW); Dongguan Broaden Sports Goods Ltd., Dongguan, Guang Dong Province (CN)

(72) Inventor: Chien-Chuan Lo, Hua-Lien Hsien (TW)

(73) Assignees: Chien-Chuan Lo, Hua-Lien Hsien (TW); Yi-Chen Tsai, Hua-Lien Hsien (TW); Dongguan Broaden Sports Goods Ltd., Dongguan (CN)

( * ) Notice: Subject to any disclaimer, the term of this patent is extended or adjusted under 35 U.S.C. 154(b) by 0 days. days.

(21) Appl. No.: 15/615,618

(22) Filed: Jun. 6, 2017

(51) Int. Cl.
*A63B 41/08* (2006.01)
*A63B 43/00* (2006.01)

(52) U.S. Cl.
CPC ..... *A63B 41/085* (2013.01); *A63B 43/002* (2013.01); *A63B 2243/007* (2013.01)

(58) Field of Classification Search
CPC ..... A63B 41/08; A63B 41/085; A63B 43/002; A63B 2243/007
See application file for complete search history.

(56) References Cited

U.S. PATENT DOCUMENTS 1,667,088 A * 4/1928 Turner ..... A63B 41/085 473/599
1,678,830 A * 7/1928 Scudder ..... A63B 41/085 473/599
2,575,414 A * 11/1951 Gow ..... A63B 41/08 473/597
2,874,965 A * 2/1959 Martin ..... A63B 41/08 156/287
3,708,170 A * 1/1973 Presnell ..... A63B 41/08 473/597
4,869,504 A * 9/1989 Kralik ..... A63B 41/08 473/597
D480,774 S * 10/2003 Murphy ..... D21/712
6,629,902 B2 * 10/2003 Murphy ..... A63B 41/085 473/597
8,317,641 B1 * 11/2012 Lowinger ..... A63B 43/02 473/597
2002/0169040 A1 * 11/2002 Wu ..... A63B 41/08 473/599

* cited by examiner

*Primary Examiner* — Steven Wong
(74) *Attorney, Agent, or Firm* — Lewis Roca Rothgerber Christie LLP

(57) ABSTRACT

A football includes an outer cover defining an interior space and having two rows of lace holes arranged in pairs spaced apart from each other along a longitudinal direction, and a mounting area disposed between the two rows of lace holes. A lace unit includes a main body disposed on the mounting area and formed with a plurality of positioning grooves, and a plurality of laces connected to the main body and corresponding in position to the positioning grooves. Each lace is extended through a respective pair of the lace holes, is looped around the main body and the mounting area, and is positioned in a respective positioning groove.

9 Claims, 15 Drawing Sheets

FOOTBALL CAPABLE OF BEING QUICKLY LACED

FIELD

The disclosure relates to a football, more particularly to a football that is capable of being quickly laced.

BACKGROUND

Referring to FIG. 1, a conventional football includes an outer cover 1 and a single lace 2. The outer cover 1 has a plurality of lace holes 101 arranged in pairs spaced apart from each other along a longitudinal direction (X). After the lace 2 is laced through the pairs of lace holes 101, the lace 2 is formed with a plurality of transverse lace portions 201 spaced apart from each other along the longitudinal direction (X), and two longitudinal lace portions 202 disposed side by side and extending through the transverse lace portions 201. This configuration increases the friction force during throwing of the football by a user.

Referring to FIGS. 2 to 4, during making of the aforesaid conventional football, the lace 2 is extended through the pairs of lace holes 11 in sequence and in a spiral manner. That is, after the lace 2 is extended through one of the pairs of lace holes 101 twice and is tightly pulled to form one of the transverse lace portions 201, the lace 2 must then be moved obliquely toward the next adjacent pair of lace holes 101 so as to extend smoothly therethrough and form the next transverse lace portion 201. Since the length of the single lace 2 is long, an end of the lace 2 must be found every time the lace 2 is to extend through a corresponding pair of lace holes 101, so that a lot of time is consumed, thereby adversely affecting the production efficiency of the conventional football. Further, as shown in FIG. 4, uneven forces may be applied during pulling of the transverse lace portions 201, so that the transverse lace portions 201 are not uniformly tightened. As such, each transverse lace portion 201 may have a width (W) measured along a transverse direction (Y) transverse to the longitudinal direction (X) different from that of the other transverse lace portion 201. Further, a distance (D) between two adjacent ones of the transverse lace portions 201 may be different from a distance (D) between another two adjacent ones of the transverse lace portions 201. In addition, the outermost ones of the transverse lace portions 201 may slide out of two opposite ends of the longitudinal lace portions 202 due to uneven pulling forces or poor production control.

SUMMARY

Therefore, an object of the present disclosure is to provide a football that can alleviate at least one of the drawbacks of the prior art.

According to this disclosure, a football comprises an outer cover and a lace unit. The outer cover defines an interior space and includes two rows of lace holes arranged in pairs spaced apart from each other along a longitudinal direction, and a mounting area disposed between the two rows of lace holes. The lace unit is disposed on the outer cover, and includes a main body disposed on the mounting area along the longitudinal direction, and a plurality of laces connected to the main body and spaced apart from each other along the longitudinal direction. The main body is formed with a plurality of positioning grooves spaced apart from each other along the longitudinal direction. The laces correspond in position to the positioning grooves. Each lace is extended through a corresponding pair of the lace holes, is looped around the main body and the mounting area, and is positioned in a respective one of the positioning grooves.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
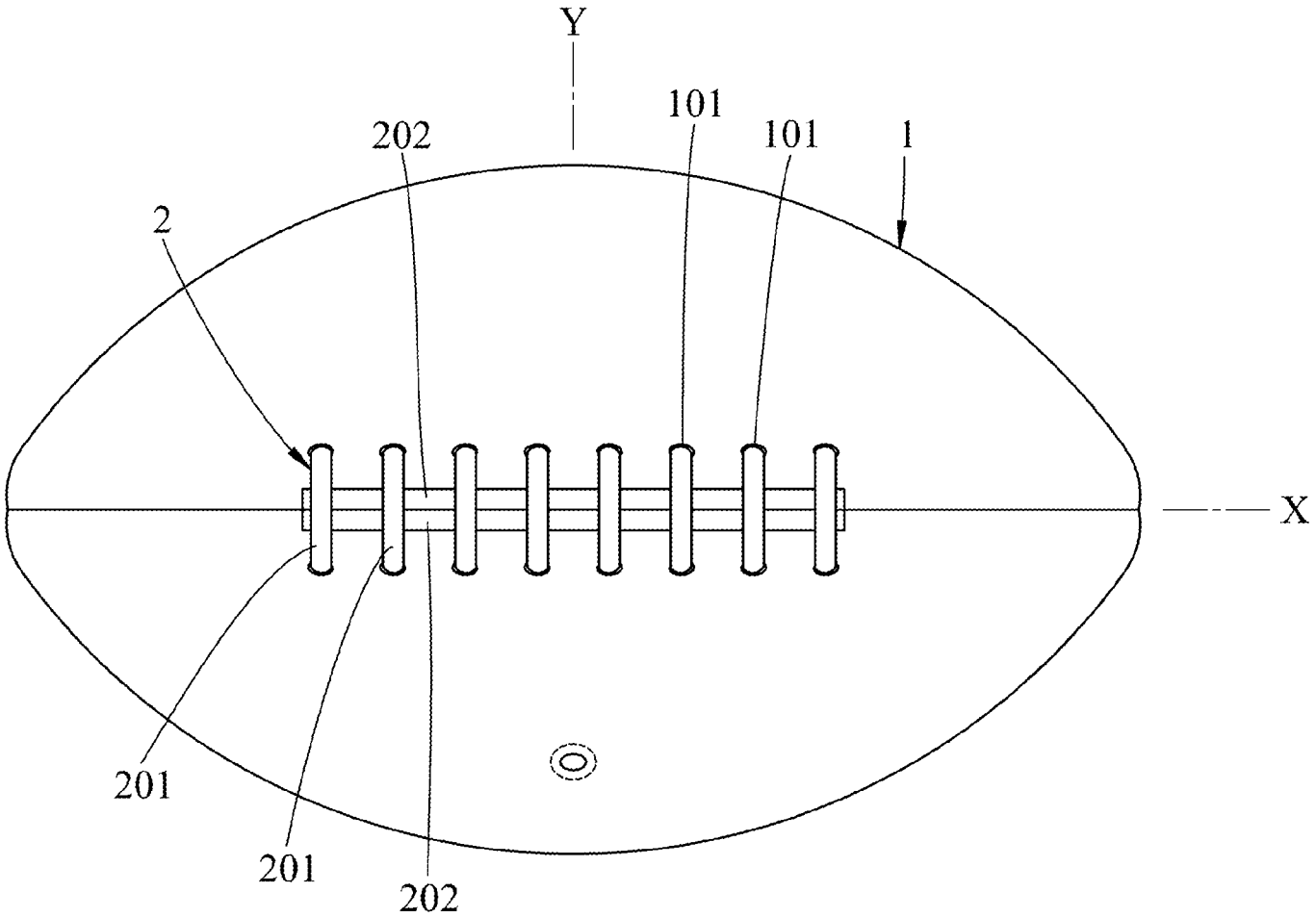
FIG.1 PRIOR ART
FIG. 1 is a schematic view of a conventional football.
Figure 2:
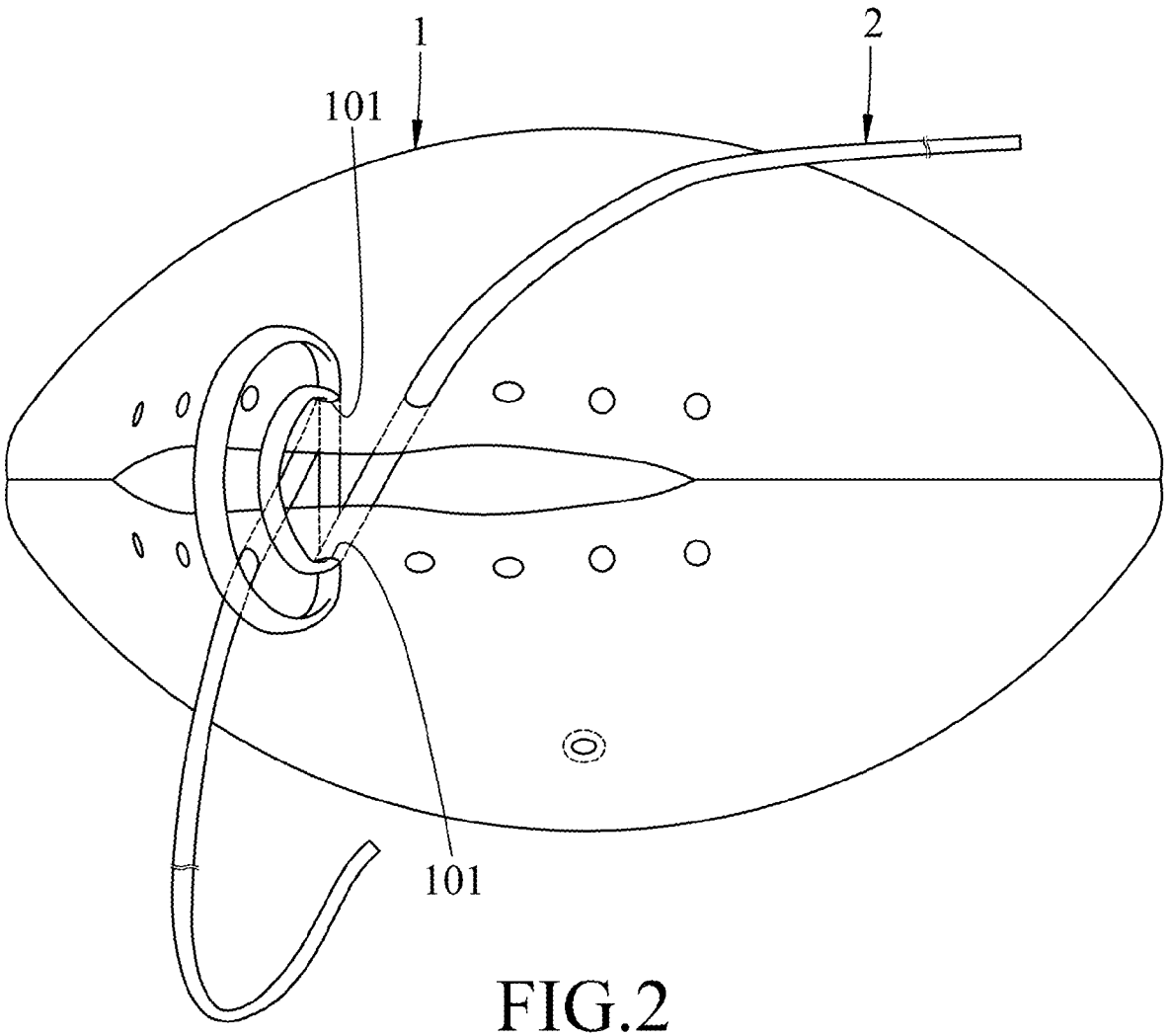
FIG.2 PRIOR ART
FIG. 2 illustrates how a lace of the conventional football is laced through pairs of lace holes in a spiral manner.
Figure 3:
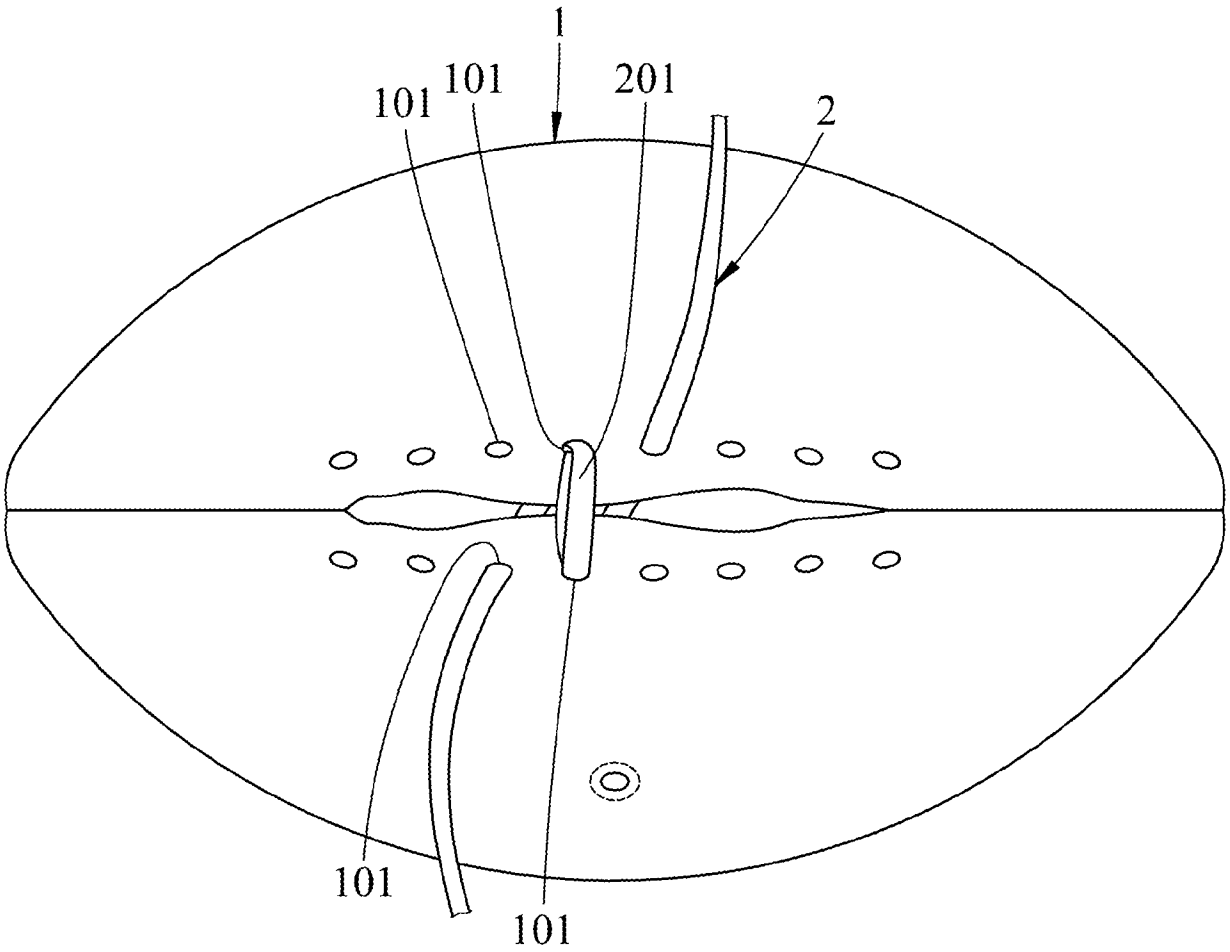
FIG.3 PRIOR ART
FIG. 3 is a view similar to FIG. 2, but illustrating the lace being tightly pulled to form a transverse lace portion.
Figure 4:
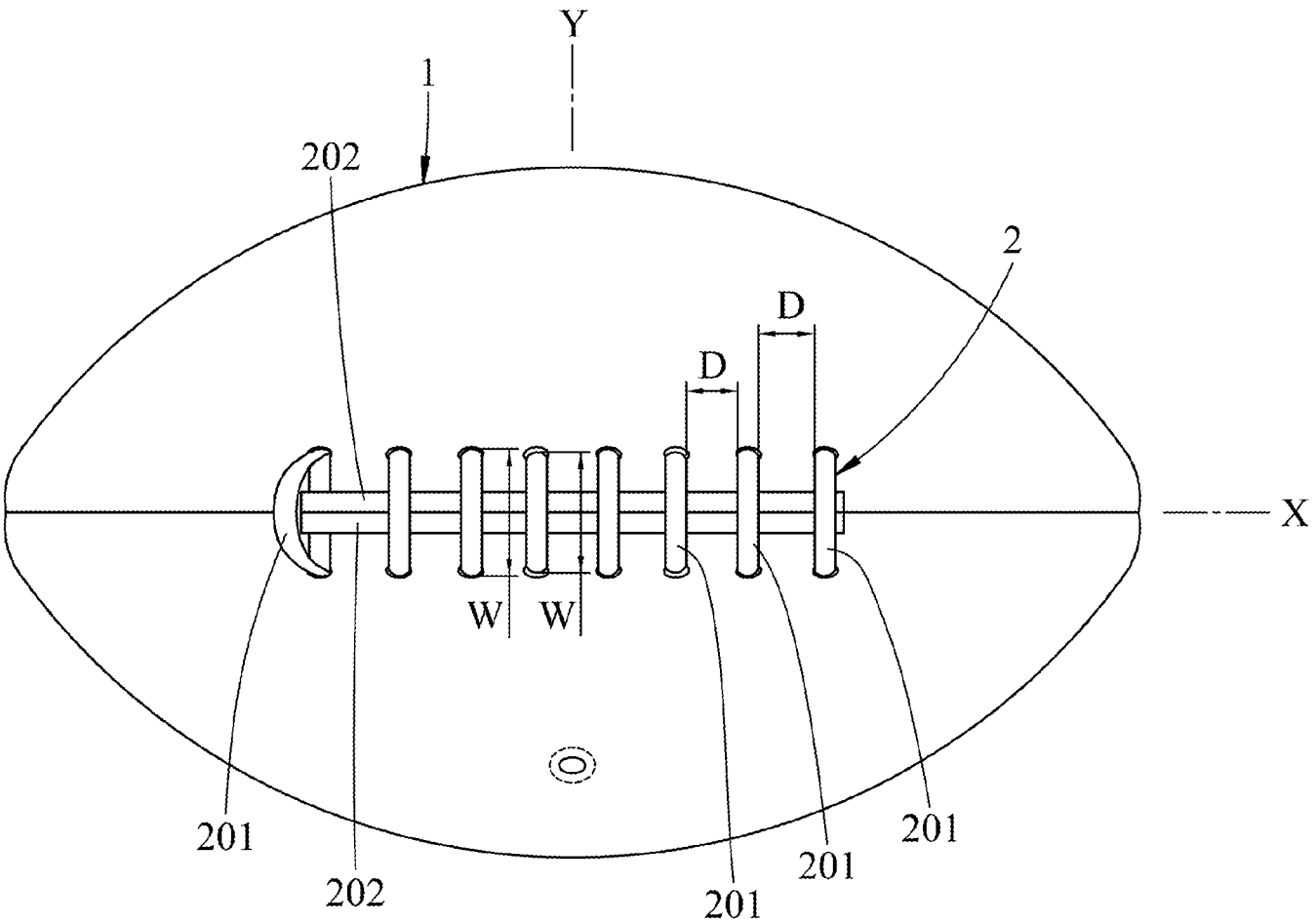
FIG.4 PRIOR ART
FIG. 4 is a view similar to FIG. 1, but illustrating the transverse lace portions formed by the lace having different distances from each other and different tightness.

Before the present disclosure is described in greater detail with reference to the accompanying embodiment, it should be noted herein that like elements are denoted by the same reference numerals throughout the disclosure.

Figure 5:
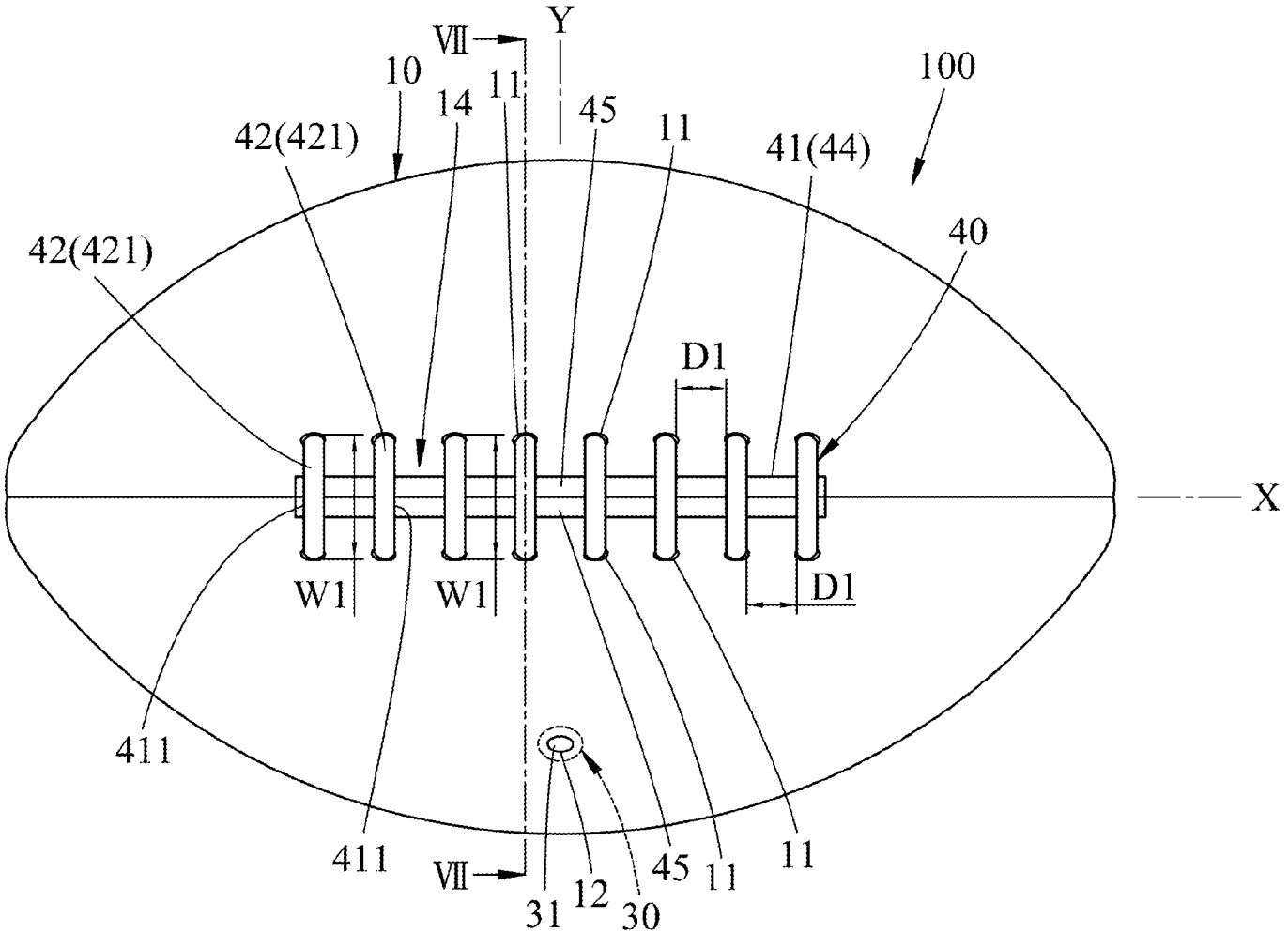
FIG. 5 is a schematic view of a football according to the first embodiment of the present disclosure.
Figure 6:
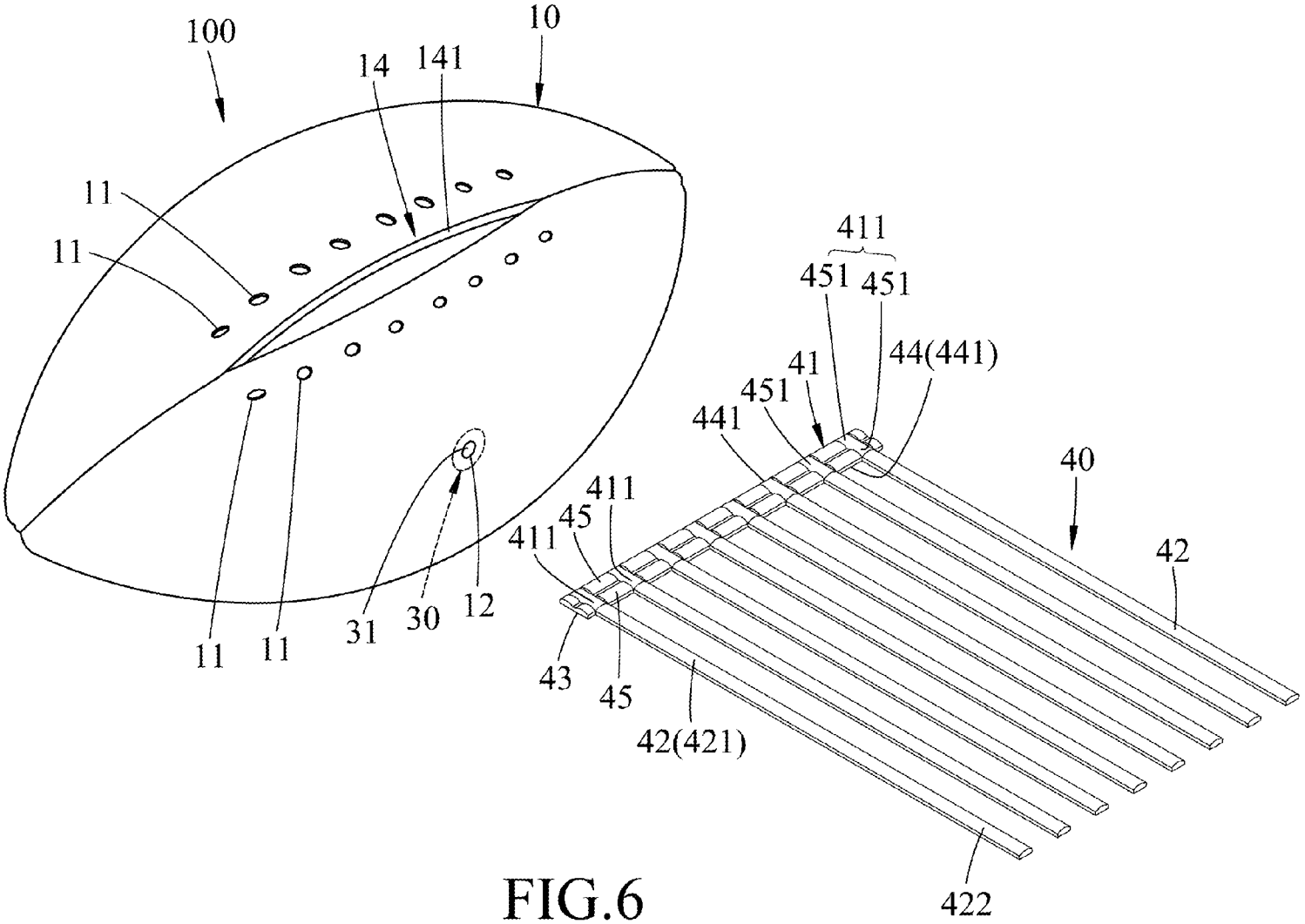
FIG. 6 is a partly exploded perspective view of the first embodiment.
Figure 7:
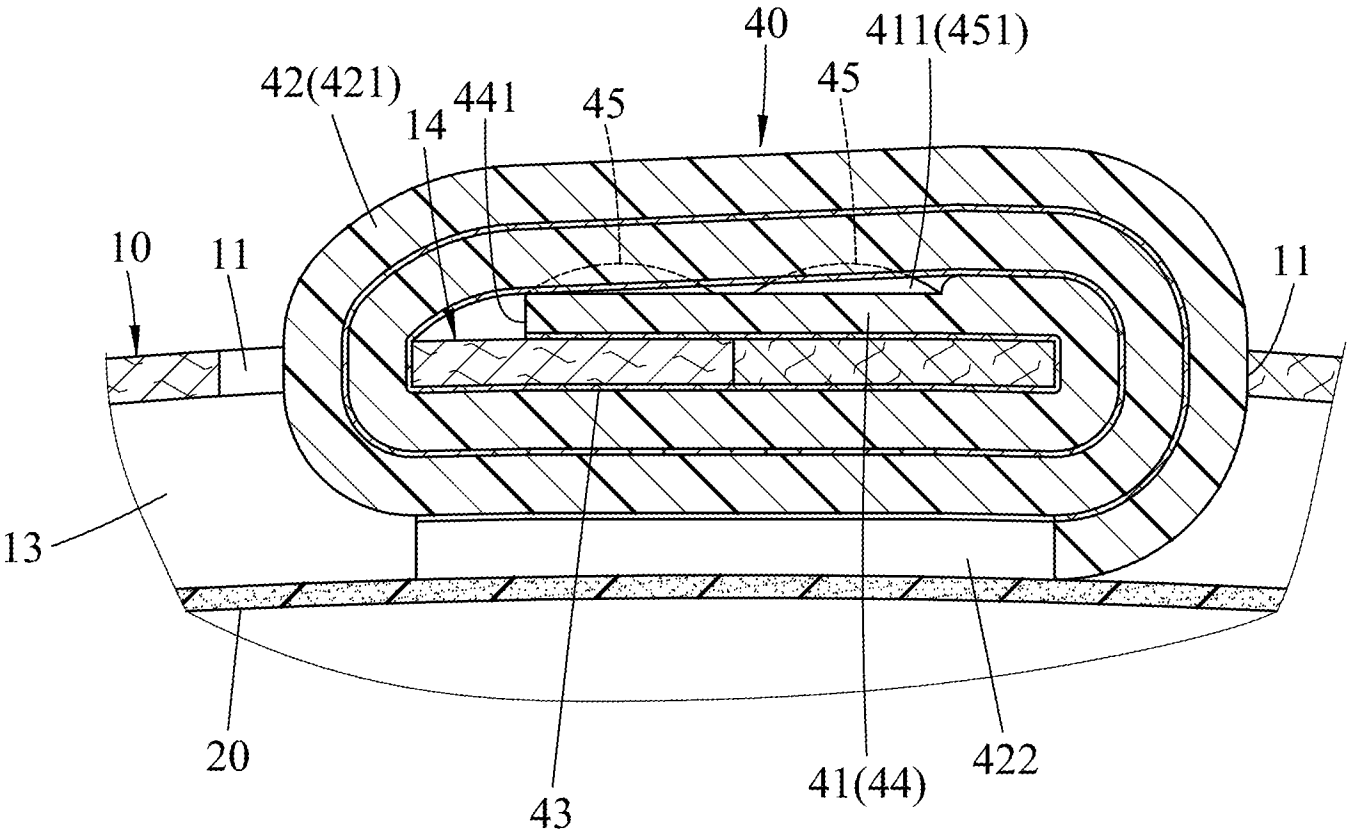
FIG. 7 is a sectional view of the first embodiment taken along line VII-VII of FIG. 5.

Referring to FIGS. 5 to 7, a football 100 according to the first embodiment of the present disclosure is shown to include an outer cover 10, an inflatable inner bladder 20, and a lace unit 40.

The outer cover 10 defines an interior space 13 and includes a mounting area 14 having an opening 141 that communicates with the interior space 13, two rows of lace holes 11 formed in the mounting area 14 at two opposite sides of the opening 141 and arranged in pairs spaced apart from each other along a longitudinal direction (X), and an inflating hole 12 spaced apart from the mounting area 14. It should be understood that the outer cover 10 is generally made by sewing four leather panels together.

The inflatable inner bladder 20 is inserted into the interior space 13 via the opening 141, and includes an inflating unit 30 having an inflating valve 31 corresponding to the inflating hole 12.

The lace unit 40 includes a main body 41, a plurality of laces 42, and a fabric base 43. The main body 41 includes a base plate 44 disposed on the mounting area 14 along the longitudinal direction (X), two longitudinal strips 45 disposed side by side on an outer surface of the base plate 44, and a plurality of positioning grooves 411 spaced apart from each other along the longitudinal direction (X). In this embodiment, the base plate 44 has two opposite side edges 441 extending along the longitudinal direction (X), and each longitudinal strip 45 has a plurality of depressions 451 spaced apart from each other along the longitudinal direction (X). Each depression 451 of one of the longitudinal strips 45 corresponds in position to a respective one of the depressions 451 of the other longitudinal strip 45 and cooperates with the same to define a corresponding one of the positioning grooves 411.

The laces 42 are connected to one of the side edges 441 of the base plate 44, are spaced apart from each other along the longitudinal direction (X), and correspond in position to the positioning grooves 411. In this embodiment, the laces 42 are integrally connected as one piece with the base plate 44. Each lace 42 has a first lace section 421 connected to the base plate 44, and a second lace section 422 connected to the first lace section 421 opposite to the base plate 44.

Each lace 42 is extended through a respective pair of lace holes 11, is looped around the base plate 44 and the mounting area 14 to close the opening 141, and is positioned in a respective one of the positioning grooves 411. In this embodiment, the first lace section 421 of each lace 42 is looped twice around the base plate 44 and the mounting area 14, and is positioned in the respective positioning groove 411. The second lace section 422 of each lace 42 is obliquely located in the interior space 13 between the outer cover 10 and the inner bladder 20.

The fabric base 43 is disposed on an inner surface of the base plate 44 and inner surfaces of the laces 42 to reinforce the base plate 44 and the laces 42. In this embodiment, the main body 41 and the laces 42 can be made of a material selected from the group consisting of PVC, PU, TPR, TPE, silicone and rubber, but is not limited thereto.

Figure 8:
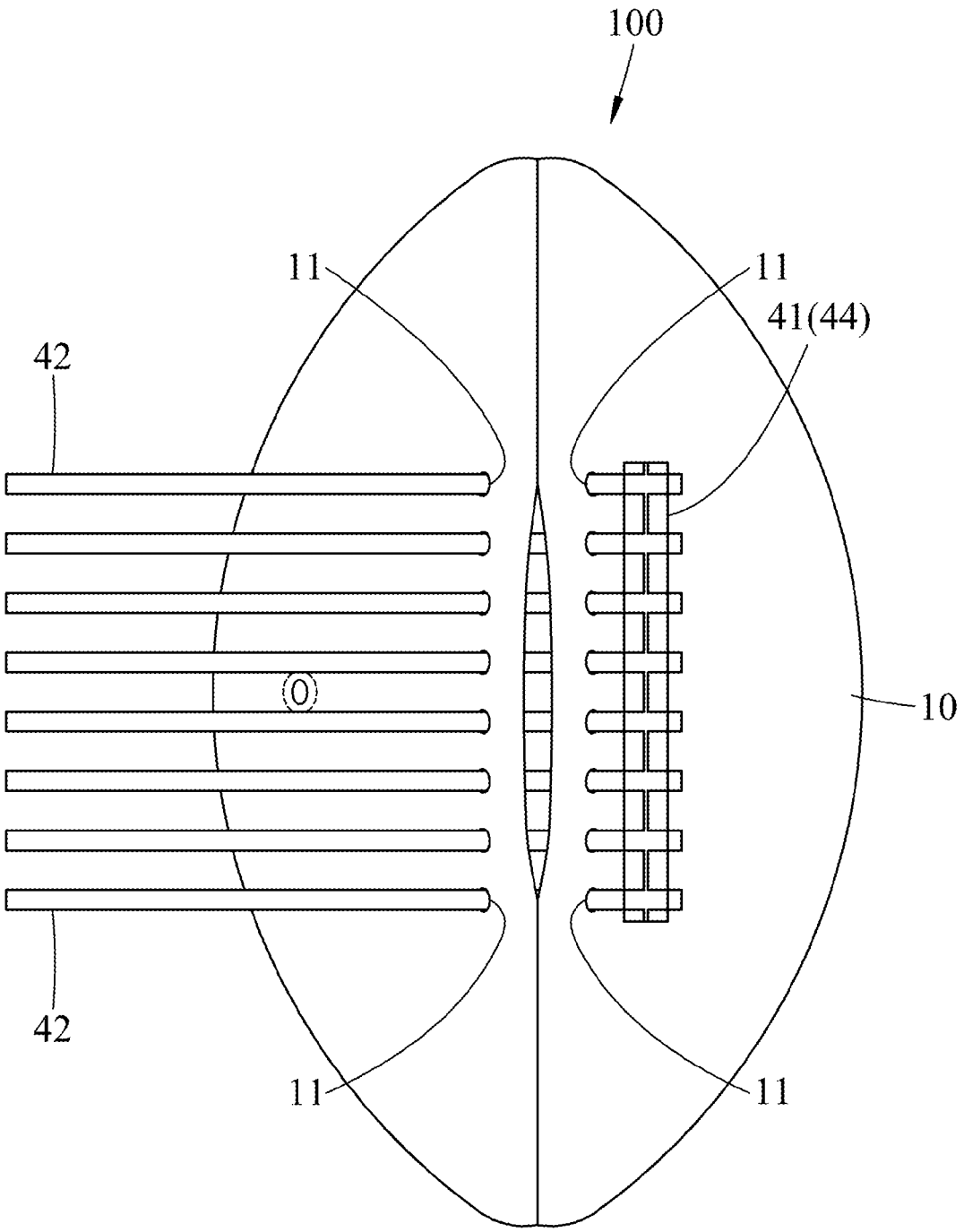
FIG. 8 is a schematic view of the first embodiment, illustrating a plurality of laces respectively extending through pairs of lace holes in an outer cover of the first embodiment.
Figure 9:
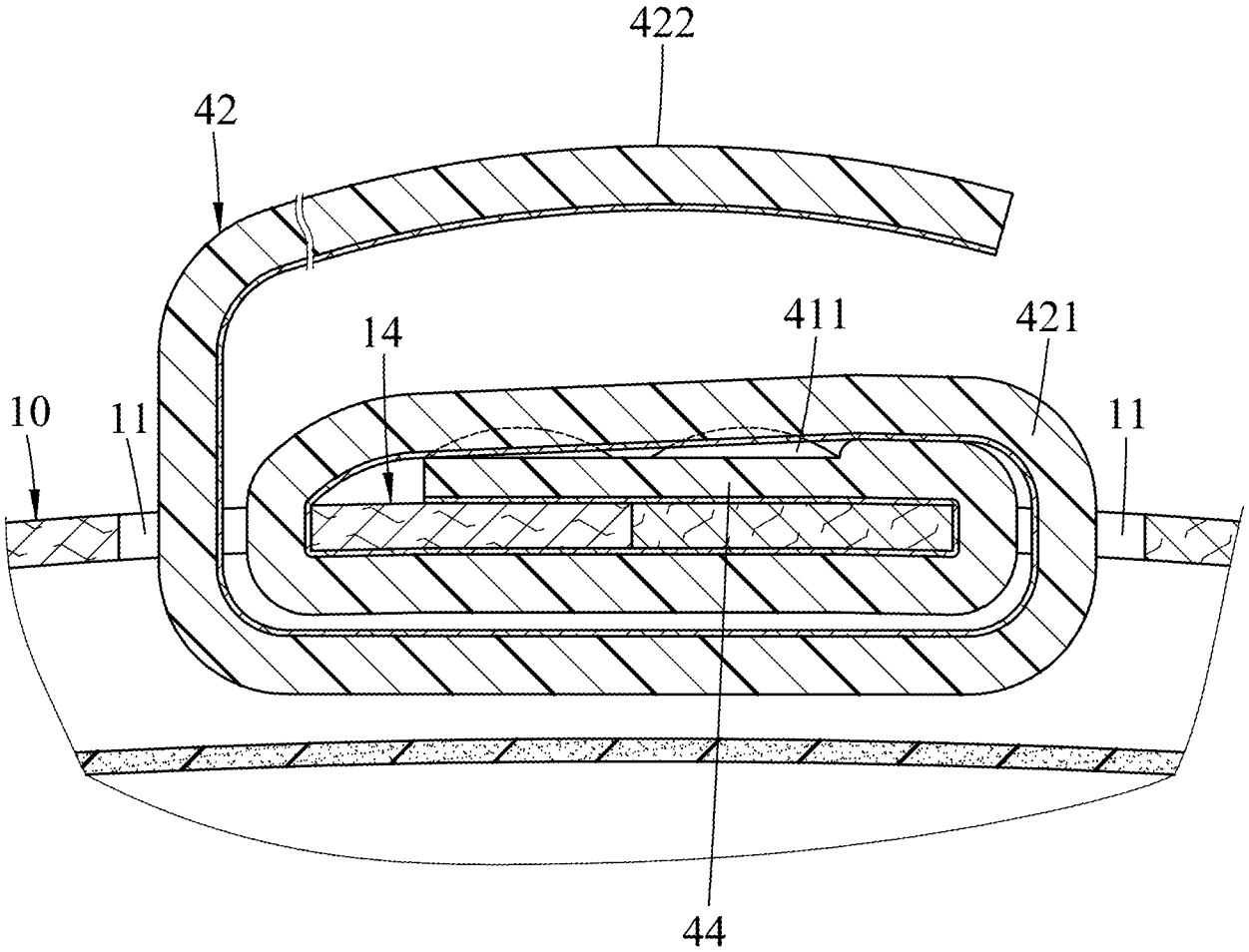
FIG. 9 is a fragmentary sectional view of the first embodiment, illustrating how a lace is inserted through a respective pair of lace holes and is looped around a base plate and a mounting area.
Figure 10:
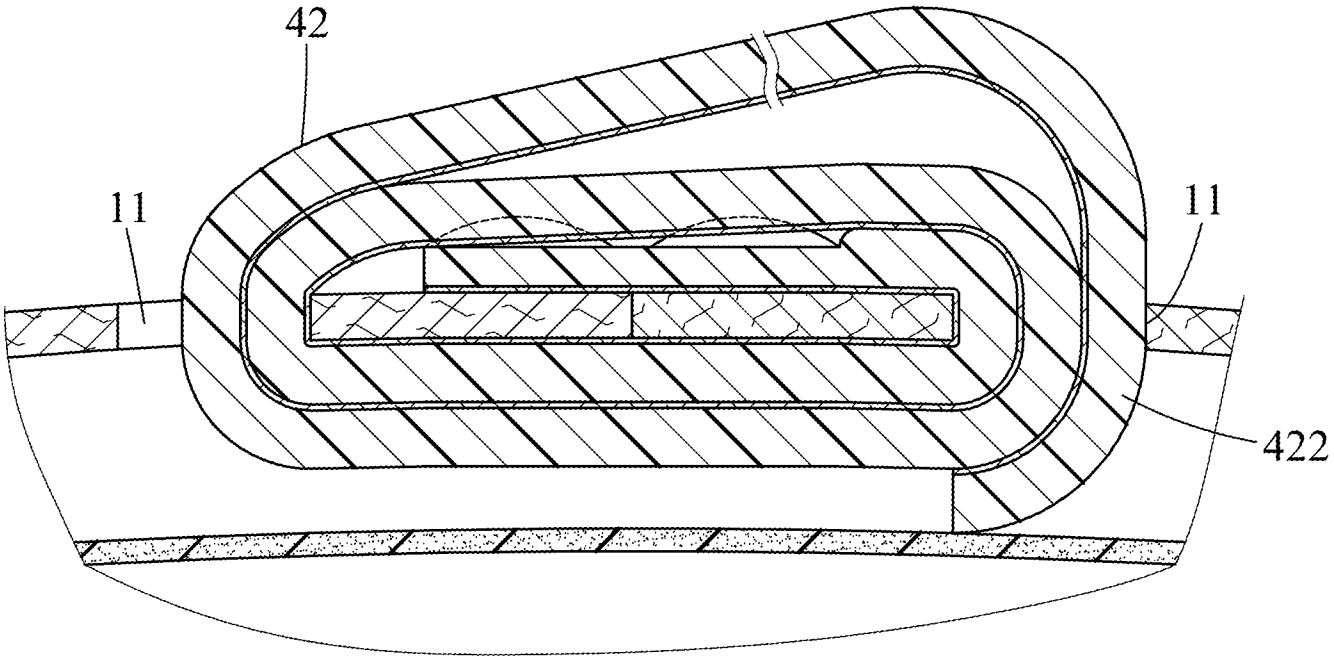
FIG. 10 is a view similar to FIG. 9, but illustrating an end of the lace being inserted again into one of the respective pair of lace holes.
Figure 11:
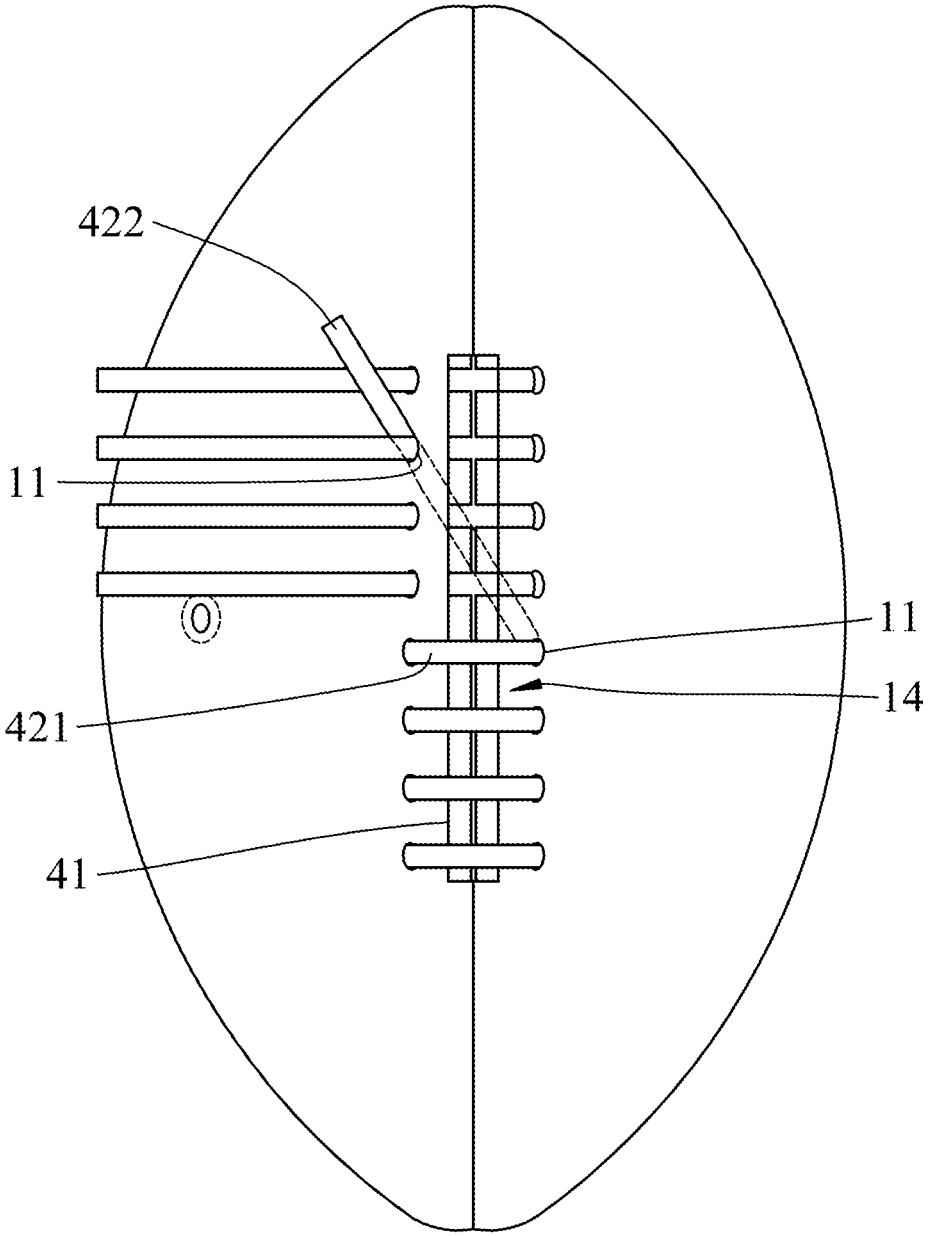
FIG. 11 is a view similar to FIG. 8, but illustrating one of the laces being pulled out from another lace hole after looping around the mounting area and the main body.
Figure 12:
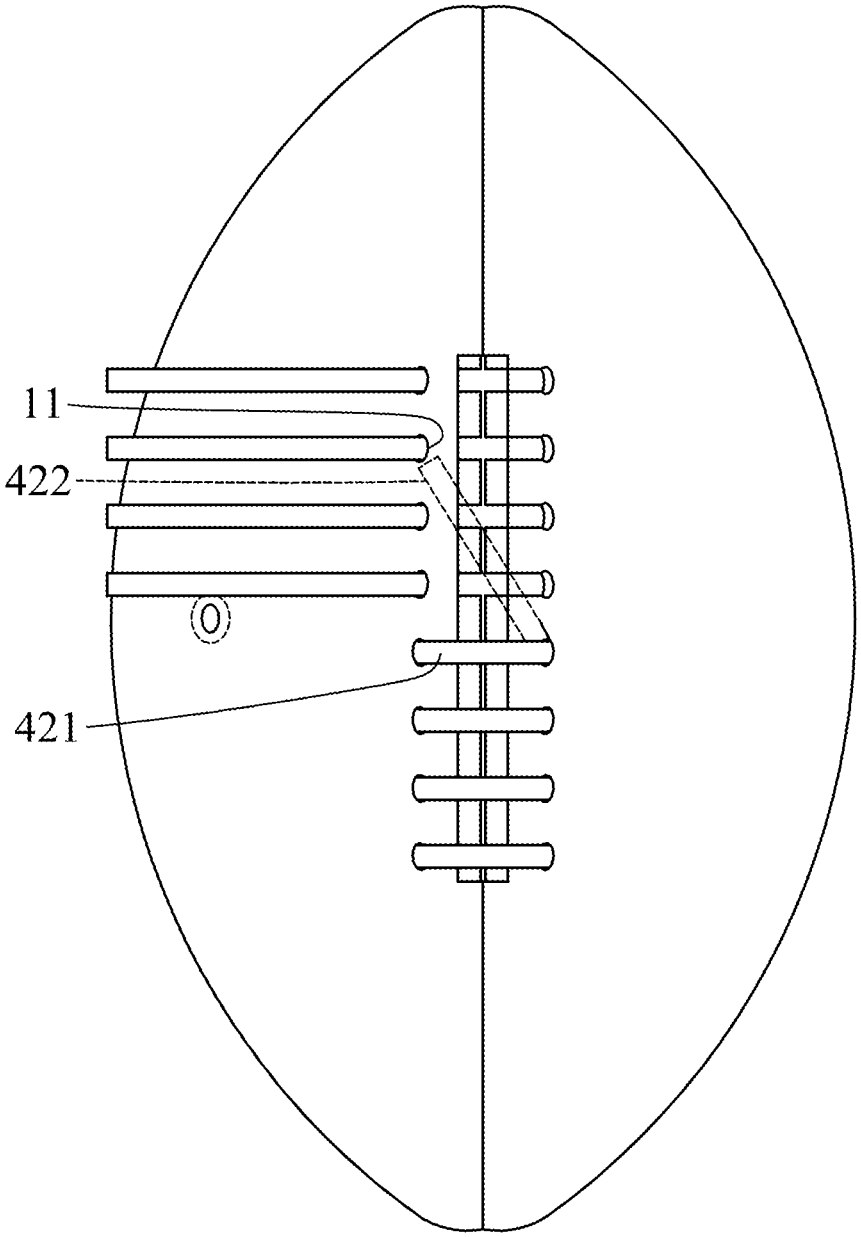
FIG. 12 is a view similar to FIG. 11, but illustrating an end portion of the one of the laces extending out from the another lace hole is removed.

Referring to FIG. 8, during making of the football 100, the laces 42 are first moved below the base plate 44 and are then inserted through the respective pairs of the lace holes 11 to extend from one side to the other side of the mounting area 14. Next, since the lacing method of each lace 42 is the same, only one of the laces 42 will be described hereinafter. Referring to FIG. 9, the lace 42 is again inserted through the respective pair of lace holes 11 so that the first lace section 421 thereof is looped around the base plate 44 and the mounting area 14 and is positioned in the corresponding positioning groove 411. Referring to FIGS. 10 and 11, the second lace section 422 is then inserted into one of the respective pair of lace holes 11, is moved obliquely relative to the first lace section 421 toward another pair of lace holes 11 spaced apart from the first lace section 421 at a predetermined distance, and is pulled out from one of the another pair of lace holes 11 opposite to the one of the respective pair of lace holes 11 until the first lace section 421 is tightly looped around the base plate 44 and the mounting area 14 (see FIG. 7), thereby closing the opening 141 of the mounting area 14. Finally, referring to FIG. 12, an end portion of the second lace section 422 extending out of the one of the another pair of lace holes 11 is cut and removed. At this time, the remaining portion of the second lace section 422 is located in the interior space 13 (see FIG. 7) between the outer cover 10 and the inner bladder 20, and is oblique relative to the first lace section 421 (see FIG. 11). Through this, the second lace section 422 cannot be easily pulled out of the lace hole 11.

Referring again to FIGS. 5 and 7, after the laces 42 are laced into the respective pairs of lace holes 11 in sequence and the first lace sections 421 thereof are looped around the main body 41 and the mounting area 14 so that the main body 41 of the lace unit 40 is fixed to the mounting area 14, the making of the football 100 is completed. At this time, the first lace sections 421 of the laces 42 are stably positioned in the corresponding positioning grooves 411, distances (D1) measured along the longitudinal direction (X) between the first lace sections 421 of each two adjacent ones of the laces 42 are the same, and the first lace sections 421 of the laces 42 that are looped around the main body 41 and the mounting area 14 have the same widths (W1) measured along a transverse direction (Y) transverse to the longitudinal direction (X).

The advantages of the first embodiment of the football 100 of this disclosure can be summarized as follows:

1. Since each lace 42 is individually laced into a respective pair of lace holes 11 at its fixed position, in comparison with the conventional football, the length of each lace 42 can be greatly shortened, so that not only the lacing of the laces 42 can be facilitated, but also, after actual test, the production efficiency of the disclosure is found to be twice that of the conventional football.

2. Since the main body 41 of the lace unit 40 is formed with the positioning grooves 411 that are equally spaced apart from each other, and since the first lace sections 421 of the laces 42 can be positioned in the corresponding positioning grooves 411 during looping around the main body 41 and the mounting area 14, in comparison with the conventional football, apart from preventing each lace 42 to slide sideward relative to the corresponding groove 411 during lacing so that the distances (D1) among the first lace sections 421 of each two adjacent ones of the laces 42 can be equally maintained, the positioning grooves 411 of this disclosure can also prevent the first lace sections 421 of two outermost ones of the laces 42 from sliding out of two opposite ends of the base plate 44. The quality of the production can thus be ensured, and a user can be allowed to easily grasp the proper technique of gripping the football.

3. Since each lace 42 is individually laced into the respective pair of lace holes 11 at its fixed position, in comparison with the conventional football, the pulling force applied to each lace 42 can be easily controlled, so that the largest pulling force received by each lace 42 is kept uniform, and the tightness of the first lace section 421 of each lace 42 after looping around the main body 41 and the mounting area 14 is consistently maintained. Further, the first lace sections 421 of the laces 42 can form the same widths (W1) along the transverse direction (Y). Hence, the shape of the football 100 is prevented from producing irregular changes.

Figure 13:
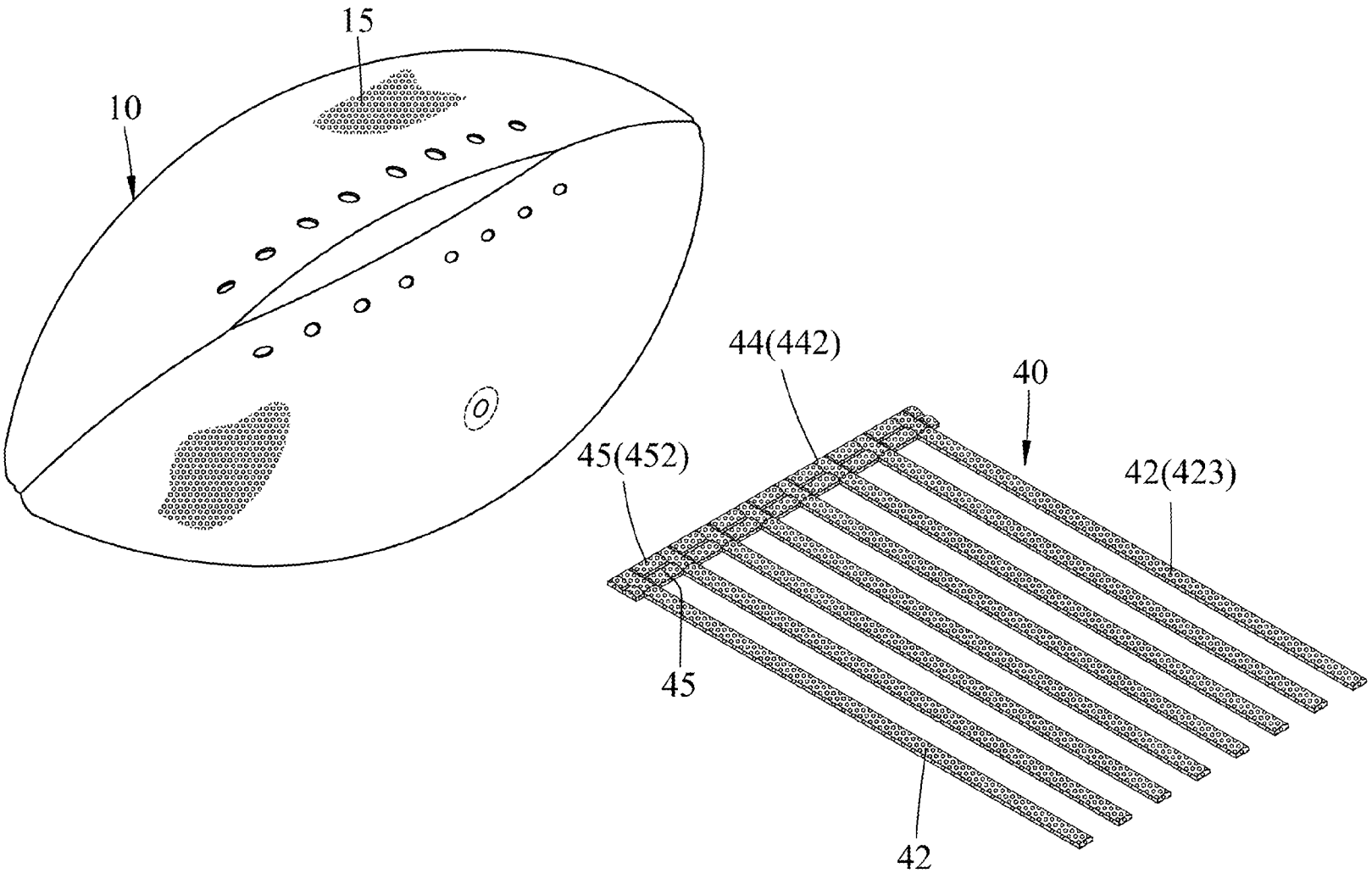
FIG. 13 is a partly exploded perspective view of a football according to the second embodiment of the present disclosure.

Referring to FIG. 13, the second embodiment of the football 100 of this disclosure is shown to be identical to the first embodiment. However, in this embodiment, the outer cover 10 is formed with an outer cover pattern 15, the outer surface of the base plate 44 is formed with a base plate pattern 442 identical to the outer cover pattern 15, each longitudinal strip 45 is formed with a longitudinal strip pattern 452 identical to the outer cover pattern 15, and each lace 42 of the lace unit 40 is formed with a lace pattern 423 identical to the outer cover pattern 15. Through this configuration, the appearance and texture of the football 100 can be enhanced. The advantages of the first embodiment can be similarly achieved using the second embodiment.

Figure 14:
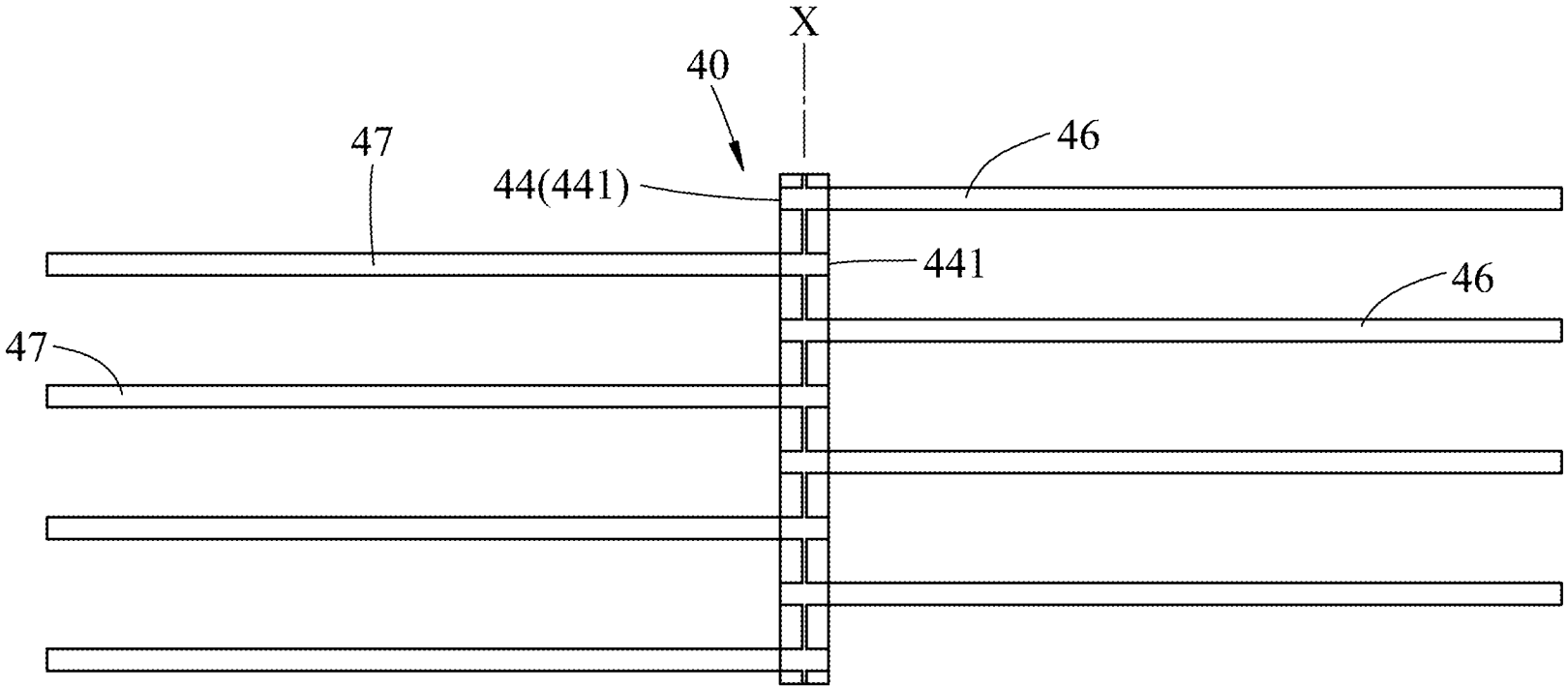
FIG. 14 is a schematic view of a lace unit of a football according to the third embodiment of the present disclosure.

Referring to FIG. 14, the third embodiment of the football 100 of this disclosure is shown to be identical to the first embodiment. However, in this embodiment, some of the laces 42 of the lace unit 40 are connected to one of the side edges 441 of the base plate 44, are equally spaced apart from each other along the longitudinal direction (X), and are defined as first laces 46. Others of the laces 42 of the lace unit 40 are connected to the other side edge 441 of the base plate 44, are equally spaced apart from each other along the longitudinal direction (X), and are defined as second laces 47. The first laces 46 and the second laces are staggered relative to each other along the longitudinal direction (X). Through this configuration, the first laces 46 and the second laces 47 can be alternately inserted into the respective pairs of lace holes 11. The advantages of the first embodiment can be similarly achieved using the third embodiment.

Figure 15:
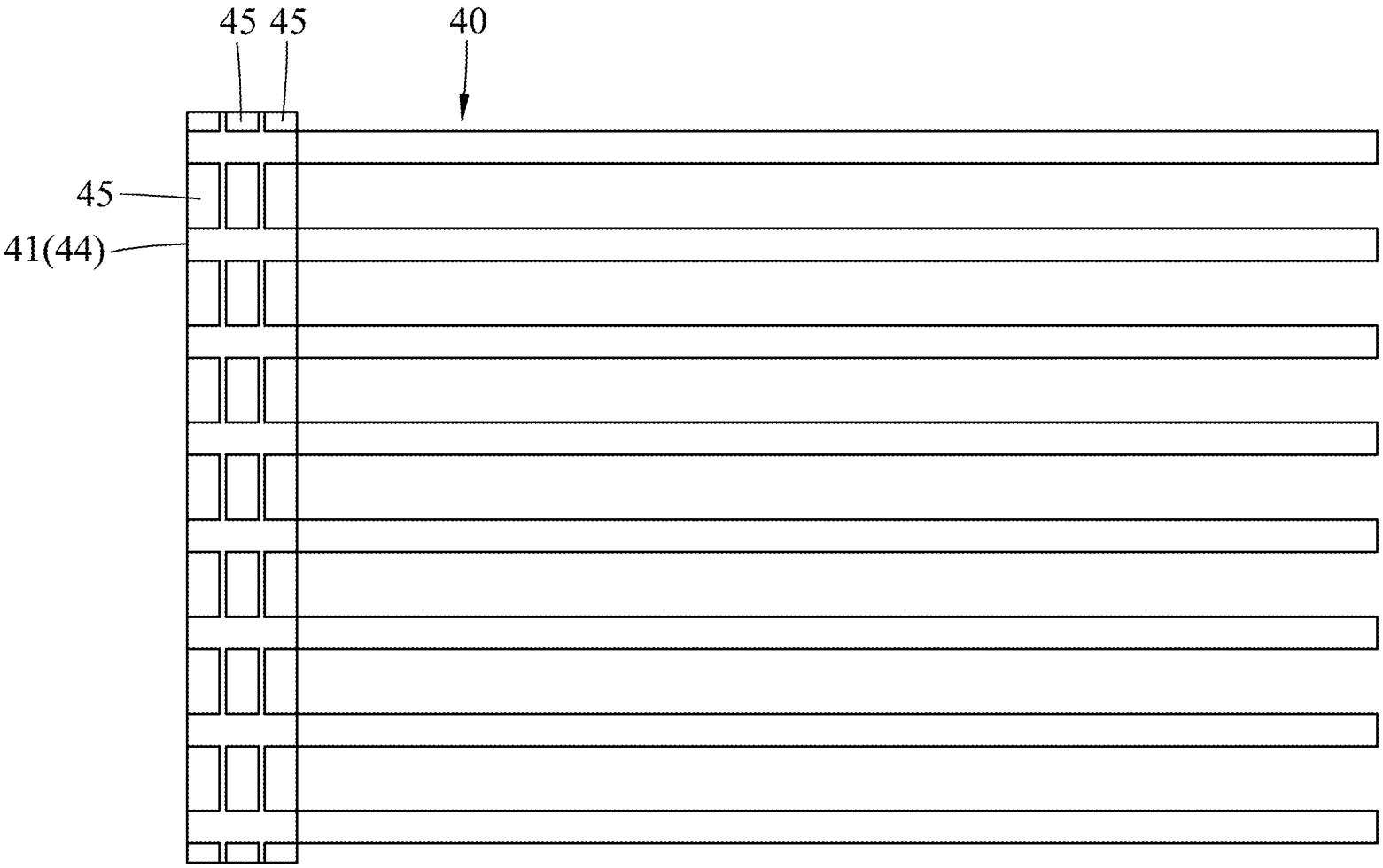
FIG. 15 is a schematic view of a lace unit of a football according to the fourth embodiment of the present disclosure.

Referring to FIG. 15, the fourth embodiment of the football 100 of this disclosure is shown to be identical to the first embodiment. However, in this embodiment, the main body 41 of the lace unit 40 includes three longitudinal strips 45 disposed side by side on the outer surface of the base plate 44. In other implementation of this embodiment, the number of the longitudinal strip 45 may be more than three. It should be understood that the number of the longitudinal strips 45 can be adjusted according to the requirement of a user's ball grasping feeling. The advantages of the first embodiment can be similarly achieved using the fourth embodiment.

In sum, the football 100 of this disclosure not only can provide quick lacing operation to increase the production efficiency thereof, but also can ensure that the distances (D1) among the first lace sections 421 of each two adjacent ones of the laces 42 can be equally maintained after looping around the main body 41 and the mounting area 14, and the tightness of the laces 42 can be consistently maintained, so that the laces 42 can receive uniform pulling forces, and a normal shape of the football 100 can be maintained. Therefore, the object of this disclosure can be realized.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A football comprising:

an outer cover defining an interior space and including two rows of lace holes arranged in pairs spaced apart from each other along a longitudinal direction, and a mounting area disposed between said two rows of lace holes; and a lace unit disposed on said outer cover, and including a main body disposed on said mounting area along the longitudinal direction, and a plurality of laces connected to said main body and spaced apart from each other along the longitudinal direction, said main body being formed with a plurality of positioning grooves spaced apart from each other along the longitudinal direction, said laces corresponding in position to said positioning grooves, each of said laces being extended through a respective pair of said lace holes, being looped around said main body and said mounting area, and being positioned in a respective one of said positioning grooves;

wherein said main body includes a base plate disposed on said mounting area and extending along the longitudinal direction, and at least two longitudinal strips disposed side by side on an outer surface of said base plate along the longitudinal direction, said laces being connected to said base plate, each of said longitudinal strips having a plurality of depressions spaced apart from each other along the longitudinal direction, each of said depressions of one of said longitudinal strips corresponding in position to a respective one of said depressions of the other one of said longitudinal strips and cooperating with the same to define a corresponding one of said positioning grooves.

2. The football as claimed in claim 1, wherein said base plate has two opposite side edges extending along the longitudinal direction, and said laces are connected to one of said side edges.

3. The football as claimed in claim 2, wherein said lace unit further includes a fabric base disposed on an inner surface of said base plate and inner surfaces of said laces.

4. The football as claimed in claim 3, wherein said outer cover is formed with an outer cover pattern, said base plate is formed with a base plate pattern identical to said outer cover pattern, each of said longitudinal strips is formed with a longitudinal strip pattern identical to said outer cover pattern, and each of said laces is formed with a lace pattern identical to said outer cover pattern.

5. The football as claimed in claim 1, wherein each of said laces has a first lace section connected to said base plate, and a second lace section connected to said first lace section opposite to said base plate, said first lace section being looped around said base plate and said mounting area, said second lace section being located in said interior space.

6. The football as claimed in claim 5, wherein said second lace section is oblique relative to said first lace section.

7. The football as claimed in claim 1, wherein said base plate has two opposite side edges extending along the longitudinal direction, some of said laces being connected to one of said side edges and being defined as first laces, others of said laces being connected to the other one of said side edges and being defined as second laces, said first laces and said second laces being staggered relative to each other along the longitudinal direction.

8. The football as claimed in claim 1, wherein said main body includes three said longitudinal strips.

9. The football as claimed in claim 1, further comprising an inflatable inner bladder disposed in said interior space and including an inflating unit, said outer cover further including an inflating hole spaced apart from said mounting area, said inflating unit corresponding to said inflating hole.

* * * * *